United States Patent [19]

Migliore

[11] Patent Number: 4,680,914

[45] Date of Patent: Jul. 21, 1987

[54] METHOD OF INSTALLING MARBLE PANELS

[76] Inventor: Neil Migliore, 234 New York Ave., Huntington, N.Y. 11743

[21] Appl. No.: 832,049

[22] Filed: Feb. 21, 1986

Related U.S. Application Data

[63] Continuation-in-part of Ser. No. 763,524, Aug. 8, 1985, Pat. No. 4,640,076, and a continuation-in-part of Ser. No. 766,270, Aug. 16, 1985, Pat. No. 4,601,147.

[51] Int. Cl.[4] ..... E04G 21/00

[52] U.S. Cl. ..... 52/747; 52/311; 52/390; 52/746; 52/811

[58] Field of Search ..... 52/98, 311, 313, 390, 52/747, 746, 811; 156/71, 256; 206/321, 322

[56] References Cited

U.S. PATENT DOCUMENTS

| | | | |
|---|---|---|---|
| 1,893,430 | 1/1933 | McKenzie | 52/311 X |
| 3,444,660 | 5/1969 | Feichter et al. | 52/385 X |
| 3,533,206 | 10/1970 | Passeno, Jr. | 52/387 |
| 3,730,797 | 5/1973 | Jensen | 156/254 X |
| 3,950,202 | 4/1976 | Hodges | 52/612 X |
| 4,063,982 | 12/1977 | Bourke | 156/254 |

*Primary Examiner*—Alfred C. Perham
*Attorney, Agent, or Firm*—Peter L. Berger

[57] ABSTRACT

A method of installing marble panels on a flat wall, includes the steps of cutting a slab of marble having a front face and opposite ends, into a plurality of thin marble sheets; attaching a backing panel to opposite sides of each marble sheet; cutting each marble sheet in half to define two marble panels, each comprised of a marble layer and a backing panel; installing the marble panels on the flat wall such that marble layers which represent successive cuts from said slab of marble are adjacent to each other and such that adjacent side edges of adjacent marble layers are in abutting relation and correspond to the same end of the slab of marble, to form a continuous pattern on the flat wall.

6 Claims, 7 Drawing Figures

FIG. 1
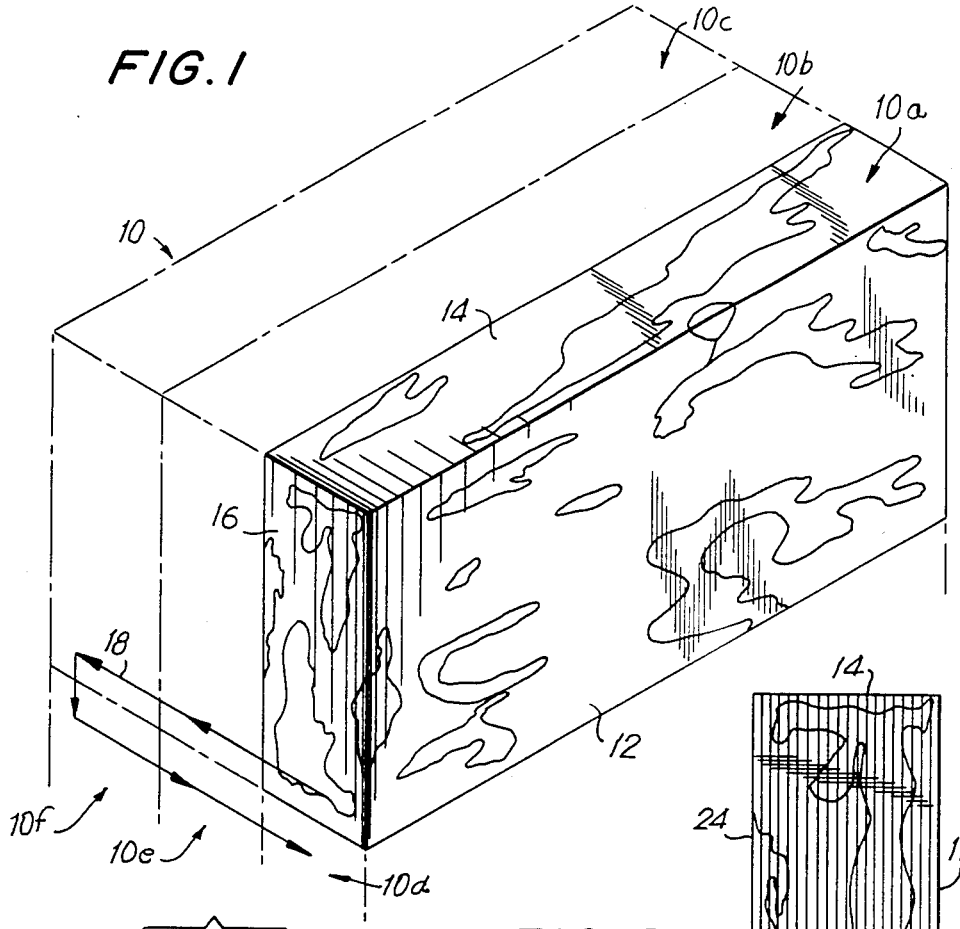
FIG. 2
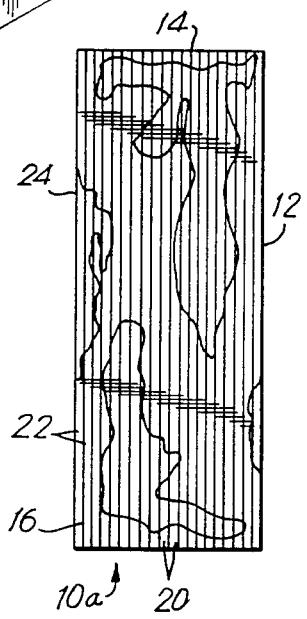
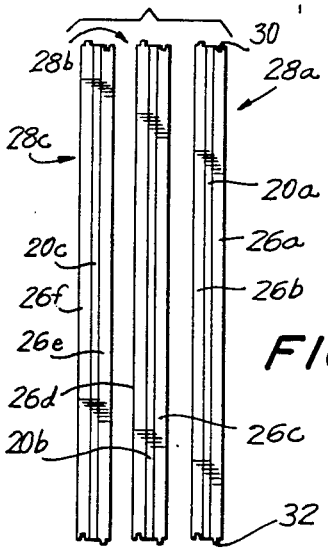
FIG. 3

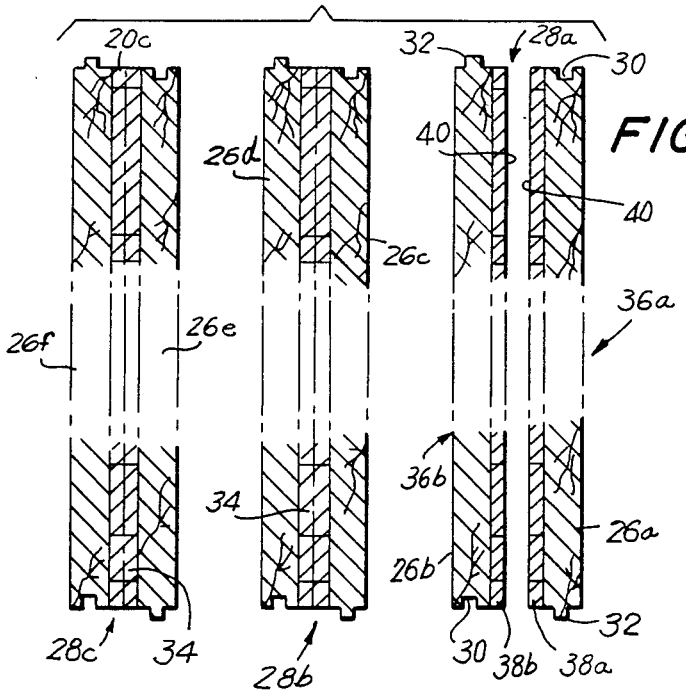
FIG. 4
FIG. 5
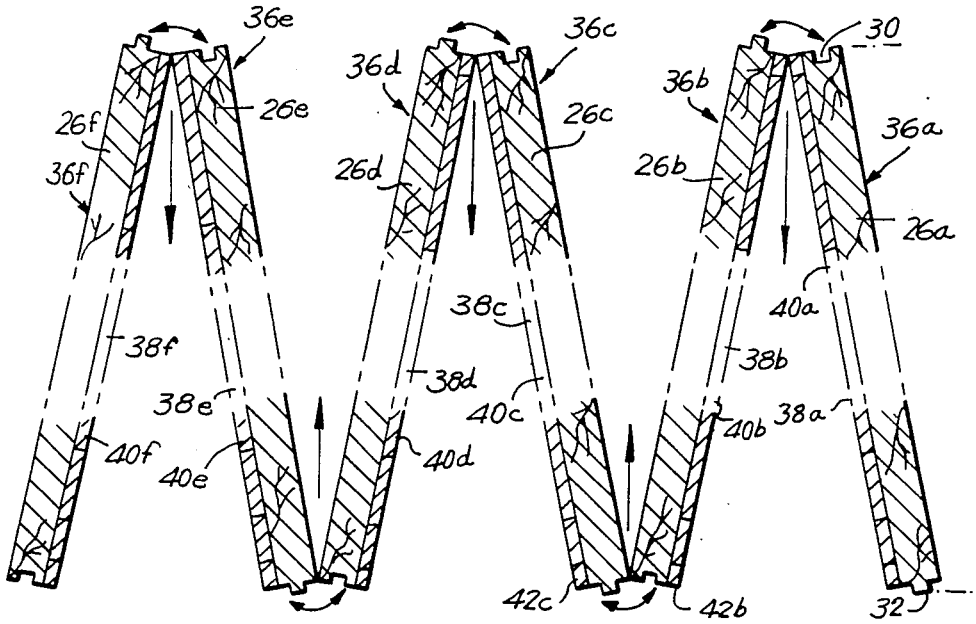

METHOD OF INSTALLING MARBLE PANELS

REFERENCE TO RELATED APPLICATIONS

The present application is a continuation-in-part of copending U.S. patent application Ser. No. 06/763,524, filed Aug. 8, 1985, now U.S. Pat. No. 4,640,076, issued Feb. 3, 1987, and copending U.S. patent application Ser. No. 06/766,270, filed Aug. 16, 1985, now U.S. Pat. No. 4,601,147, issued July 22, 1986, the entire disclosures of both being incorporated herein by reference.

BACKGROUND OF THE INVENTION

The present invention relates generally to a method of installing marble walls and, more particularly, is directed to a method of installing marble walls formed of a thin marble layers attached to backing panels.

In the aforementioned U.S. patent application Ser. No. 06/766,270, now Pat. No. 4,601,147 there is disclosed a novel system for assembling marble panels to a flat wall with accurate alignment. As disclosed therein, each marble panel is formed of a thin layer of marble secured to a backing or carrier panel. A groove is formed at one side edge of each backing panel, and a tongue is formed at the opposite side edge of each backing panel for insertion into a groove in an adjoining backing panel. This arrangement aids in the easy and accurate alignment of the side edges of the thin layers of marble in an abutting relation when the marble panels are assembled on a flat wall.

However, there is a problem with such a system, and in similar systems which use thin layers of marble. Specifically, the grains in each marble layer form a pattern on the front face thereof. When the marble panels are installed on the wall, the patterns on adjacent marble layers do not correspond with each other, clearly indicating that separate marble layers are being used, and more importantly, imparting a less than desirous appearance. This is particularly due to discontinuities between patterns of adjacent layers at the side edges thereof.

OBJECTS AND SUMMARY OF THE INVENTION

Accordingly, it is an object of the present invention to provide a method of installing marble panels on a flat wall such that a substantially continuous pattern extends along the wall.

It is another object of the present invention to provide a method of installing marble panels on a flat wall with the patterns of adjacent panels being continuous at the side edges thereof.

In accordance with an aspect of the present invention, a method of installing marble panels on a flat wall, includes the steps of cutting a slab of marble having a front face and opposite ends, into a plurality of thin marble layers; attaching a backing panel to each marble layer to form a plurality of marble panels; installing the marble panels on the flat wall such that marble layers which represent successive cuts from said slab of marble are adjacent to each other and such that adjacent side edges of adjacent marble layers are in abutting relation and correspond to the same end of the slab of marble, to form a continuous pattern on the flat wall.

In accordance with another aspect of the present invention, a method of installing marble panels on a flat wall, includes the steps of cutting a slab of marble having a front face and opposite ends, into a plurality of thin marble sheets; attaching a backing panel to opposite sides of each marble sheet; cutting each marble sheet in half to define two marble panels, each comprised of a marble layer and a backing panel; installing the marble panels on the flat wall such that marble layers which represent successive cuts from said slab of marble are adjacent to each other and such that adjacent side edges of adjacent marble layers are in abutting relation and correspond to the same end of the slab of marble, to form a continuous pattern on the flat wall.

The above, and other, objects, features and advantages of the present invention will become readily apparent from the following detailed description thereof which is to be read in connection with the accompanying drawings.

BRIEF DESCRIPTION OF THE DRAWINGS

FIG. 1 is a perspective view of a slab of marble from which a plurality of marble sheets is obtained;

FIG. 2 is an end plan view of a section of the marble slab of FIG. 1, used for illustrating the step of cutting the marble slab into a plurality of marble sheets;

FIG. 3 is an end plan view of three intermediate structures, each formed of a marble sheet having a backing layer secured on opposite sides thereof;

FIG. 4 is an enlarged end plan view of the three intermediate structures of FIG. 3, with the last one cut to form two marble panels;

FIG. 5 is an enlarged end plan view of the three intermediate structures of FIG. 4, each shown separated into two marble panels and indicating the manner of arrangement with respect to each other;

DETAILED DESCRIPTION OF A PREFERRED EMBODIMENT

Figure 6:
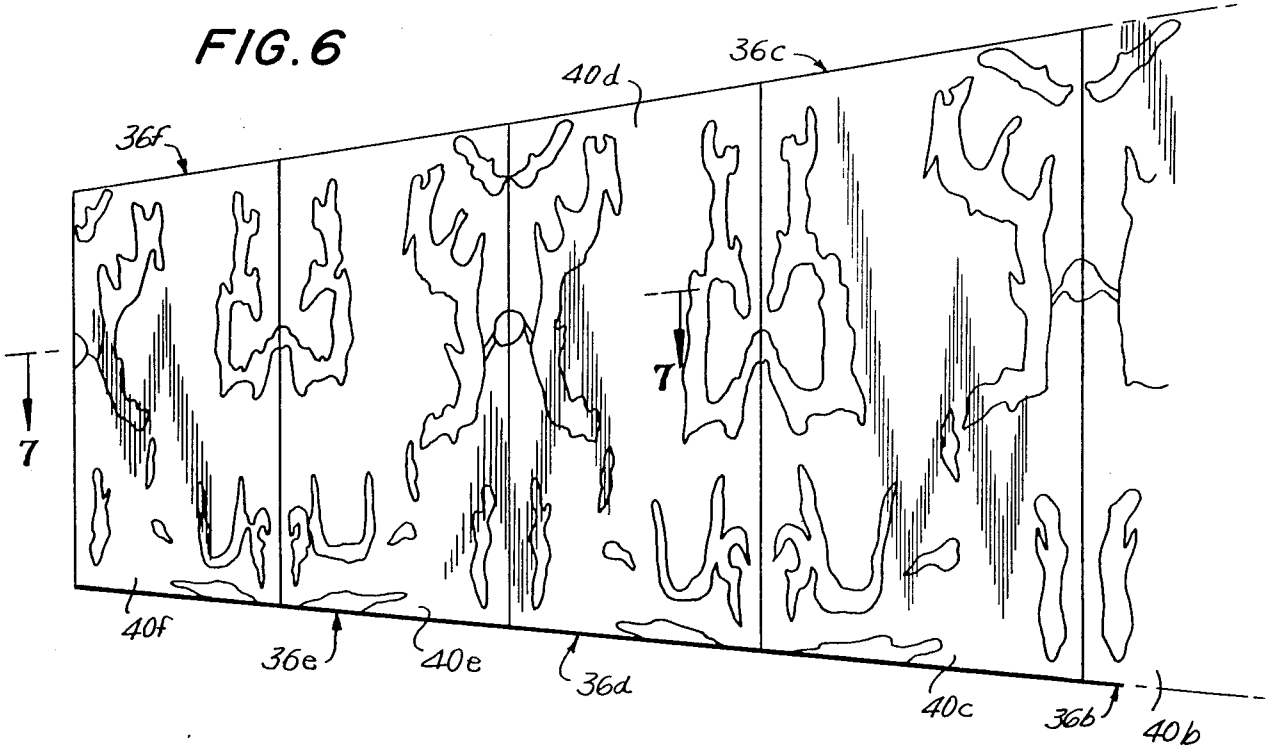
FIG. 6 is a perspective view of a flat wall having the marble panels of FIG. 5 installed thereon.

Referring to the drawings in detail, and initially to FIG. 1 thereof, there is shown a slab 10 of marble from which a plurality of thin sheets of marble are to be cut. It will be noted that the front face 12 of marble slab 10 includes a particular pattern determined by the marble grains. The pattern on the top face 14 and an end face 16 are also shown.

As shown in FIG. 1, marble slab 10 is divided into a plurality of sections 10*a*, 10*b*, 10*c*, 10*d*, 10*e* and 10*f*, the latter three only being partially shown, and sections 10*b* and 10*c* only being shown in dot dash lines. Each section is cut, in turn, as indicated by arrow 18 in FIG. 1, into a plurality of thin sheets of marble. Accordingly, the cutting of section 10*a* will first be discussed. As shown in FIG. 2, section 10*a* is cut into a plurality of thin sheets 20 of marble, as indicated by the vertical cut lines 22 therein.

It will be appreciated that the pattern on front face 12 varies and shifts as one travels from front face 12 to the rear face 24 of section 10*a*. However, the amount of shift and variation in the pattern over a small distance is not great, and may not even be visually noticeable. Thus, the pattern on the front face of any thin sheet 20 of marble will be substantially identical to that on the front face of any adjacent thin sheet 20 of marble. The present invention uses this to form a continuous pattern when the marble is installed on a flat wall, as will be described in greater detail hereinafter.

Figure 7:
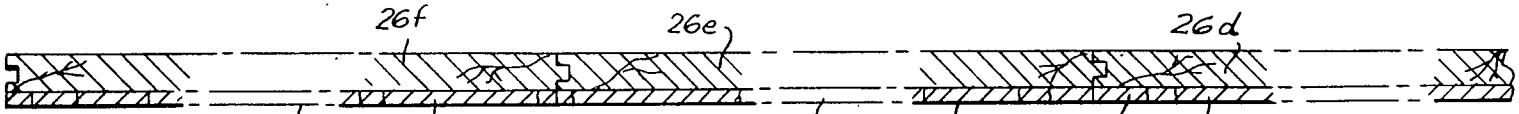
FIG. 7 is a cross-sectional view of the marble panels of FIG. 6, taken along line 7—7 thereof.

Three thin sheets 20*a*, 20*b* and 20*c* of marble are shown generally in FIG. 3, each having a backing or carrier panel 26*a*, 26*b*; 26*c*, 26*d*; and 26*e*, 26*f*, respectively, attached thereto, the intermediate structures of thin sheets 20 of marble and two backing panels 26 being referred to by numerals 28*a*, 28*b* and 28*c*, respectively. Each backing panel 26 can be constructed substantially identical to the aforementioned copending U.S. patent application Ser. No. 06/766,270, the entire disclosure of which has been incorporated herein by reference. Thus, each backing panel 26 can be constructed as a solid structure or a hollow structure, the latter having a honeycomb or web-like construction. In addition, one edge of each backing panel 26 is formed with a groove 30 and the opposite edge of each backing panel 26 is formed with a tongue 32 for insertion into a groove 30 in an adjoining marble panel, as shown in FIG. 7.

FIG. 4 shows the intermediate structures 28*a*, 28*b* and 28*c* of FIG. 3 in an enlarged scale, and which will be used for describing the next step according to the method of the present invention. Specifically, each intermediate structure 28 is divided in half along a vertical line 34 shown in FIG. 4 which extends centrally through each thin sheet 20 of marble, and then the two halves are separated as shown by by the last intermediate structure 28, to form two marble panels 36. Thus, each marble panel 36 is formed from a thin layer 38 of marble (one-half of a thin sheet 20 of marble) and a backing panel 26. Marble panels 36 constitute the end product and are installed on a flat wall, as taught by the aforementioned U.S. patent application Ser. No. 06/766,270 now U.S. Pat. No. 4,601,147. In order to better understand the present invention, marble panels 36 and thin layers 38 of marble have been designated with the letters a, b, c, d, e and f, as shown in FIGS. 4 and 5.

It will be appreciated that the resultant front faces 40 of marble layers 38*a* and 38*b* cut from the same sheet 20*a* of marble, have an identical pattern thereon. Thus, if the corresponding marble panels 36*a* and 36*b* are installed on a flat wall adjacent to each other, as indicated in FIG. 5, there will be a continuity between the patterns at the edges thereof. The same holds true for marble layers 38*c*, 38*d*; and 38*e*, 38*f*. Further, since the pattern does not vary much for a thickness equal to a thin sheet 20 of marble, the patterns at the edges 42*b* and 42*c*, shown in FIG. 5, between front faces 40*b* and 40*c* of adjacent marble layers 38*b* and 38*c* cut from adjacent thin sheets 20*a* and 20*b* of marble, will be substantially identical. The same holds true for marble layers 38*d*, 38*e*. There will thus be continuity in the pattern of marble throughout the entire wall on which the marble panels 36 are installed, as shown in FIG. 6. It is important, however, that any two abutting edges 42 of adjacent marble layers 38 correspond to the same end face, that is, end face 16 or the opposite end face, of section 10*a*, so that there is a continuity in the pattern presented on the flat wall.

It will be appreciated that various modifications can be made to the present invention. For example, instead of cutting the thin sheets 20 of marble, the marble layers 38 could be cut from section 10*a* and then a backing panel 26 would be attached to each marble layer 38. It is only important that the edges be matched to provide a continuous pattern when the marble panels are affixed to the flat wall.

Having described a specific preferred embodiment of the invention with reference to the accompanying drawings, it will be appreciated that the present invention is not limited to that precise embodiment and that various changes and modifications can be effected therein by one of ordinary skill in the art, without departing from the scope or spirit of the invention as defined in the appended claims.

What is claimed is:

1. A method of installing marble panels on a flat wall, comprising the steps of:

cutting a slab of marble having a front face and opposite ends, into a plurality of thin marble layers;

attaching a backing panel to each marble layer to form a plurality of marble panels;

installing marble layers which represent successive cuts from said slab of marble adjacent to each other on said flat wall with adjacent side edges thereof which correspond to the same end of said slab of marble being in abutting relation, to form a continuous pattern of said flat wall.

2. A method according to claim 1; wherein each backing panel includes a groove along a side edge thereof and a tongue along an opposite side edge thereof for insertion into a groove of an adjacent backing panel when said marble panels are installed on said flat wall, and wherein said step of installing further includes the step of inserting the tongue of each backing panel into a groove of an adjacent backing panel when said marble panels are installed on said flat wall.

3. A method according to claim 1; further comprising the step of initially aligning said marble panels with respect to each other prior to installing the same such that adjacent side edges of adjacent marble layers correspond to the same end of said slab of marble.

4. A method of installing marble panels on a flat wall, comprising the steps of:

cutting a slab of marble having a front face and opposite ends, into a plurality of thin marble sheets;

attaching a backing panel to each marble layer to form a plurality of marble sheets;

cutting each marble sheet in half to define two marble panels, each comprised of a marble layer and a backing panel;

installing marble layers which represent successive cuts from said slab of marble adjacent to each other on said flat wall with adjacent side edges thereof which correspond to the same end of said slab of marble being in abutting relation, to form a continuous pattern on said flat wall.

5. A method according to claim 4; wherein each backing panel includes a groove along a side edge thereof and a tongue along an opposite side edge thereof for insertion into a groove of an adjacent backing panel when said marble panels are installed on said flat wall, and wherein said step of installing further includes the step of inserting the tongue of each backing panel into a groove of an adjacent backing panel when said marble panels are installed on said flat wall.

6. A method according to claim 4; further comprising the step of initially aligning said marble panels with respect to each other prior to installing the same such that adjacent side edges of adjacent marble layers correspond to the same end of said slab of marble.

* * * * *